US005160533A

United States Patent [19]

Myrbostad et al.

[11] Patent Number: 5,160,533

[45] Date of Patent: Nov. 3, 1992

[54] METHOD FOR GRAIN REFINING OF METALS

[75] Inventors: Erling Myrbostad, Kvanne; Karl Venås, Saupstad, both of Norway

[73] Assignee: Norsk Hydro a.s., Oslo, Norway

[21] Appl. No.: 623,989

[22] PCT Filed: Jun. 30, 1989

[86] PCT No.: PCT/NO89/00068

§ 371 Date: Dec. 19, 1990

§ 102(e) Date: Dec. 19, 1990

[87] PCT Pub. No.: WO90/00205

PCT Pub. Date: Jan. 11, 1990

[30] Foreign Application Priority Data

Jun. 30, 1988 [NO] Norway ..... 882934

[51] Int. Cl.[5] ..... C22B 4/00

[52] U.S. Cl. ..... 75/10.45; 75/10.34; 75/10.43

[58] Field of Search ..... 75/10.34, 10.43, 10.45

[56] References Cited

U.S. PATENT DOCUMENTS 2,555,507 6/1951 Pratt ..... 75/10.43

3,390,979 7/1968 Greene ..... 75/10.34

*Primary Examiner*—Peter D. Rosenberg

*Attorney, Agent, or Firm*—Wenderoth, Lind & Ponack

[57] ABSTRACT

A method for grain refining of light metals is based on formation in situ of a grain refining agent. By means of an electric arc provided over the surface of a melted pool of the metal, a supplied gas, e.g. nitrogen, reacts with the metal to form the agent. The method can be carried out both batchwise or in a continuous process.

6 Claims, 1 Drawing Sheet

METHOD FOR GRAIN REFINING OF METALS

Figure 1:
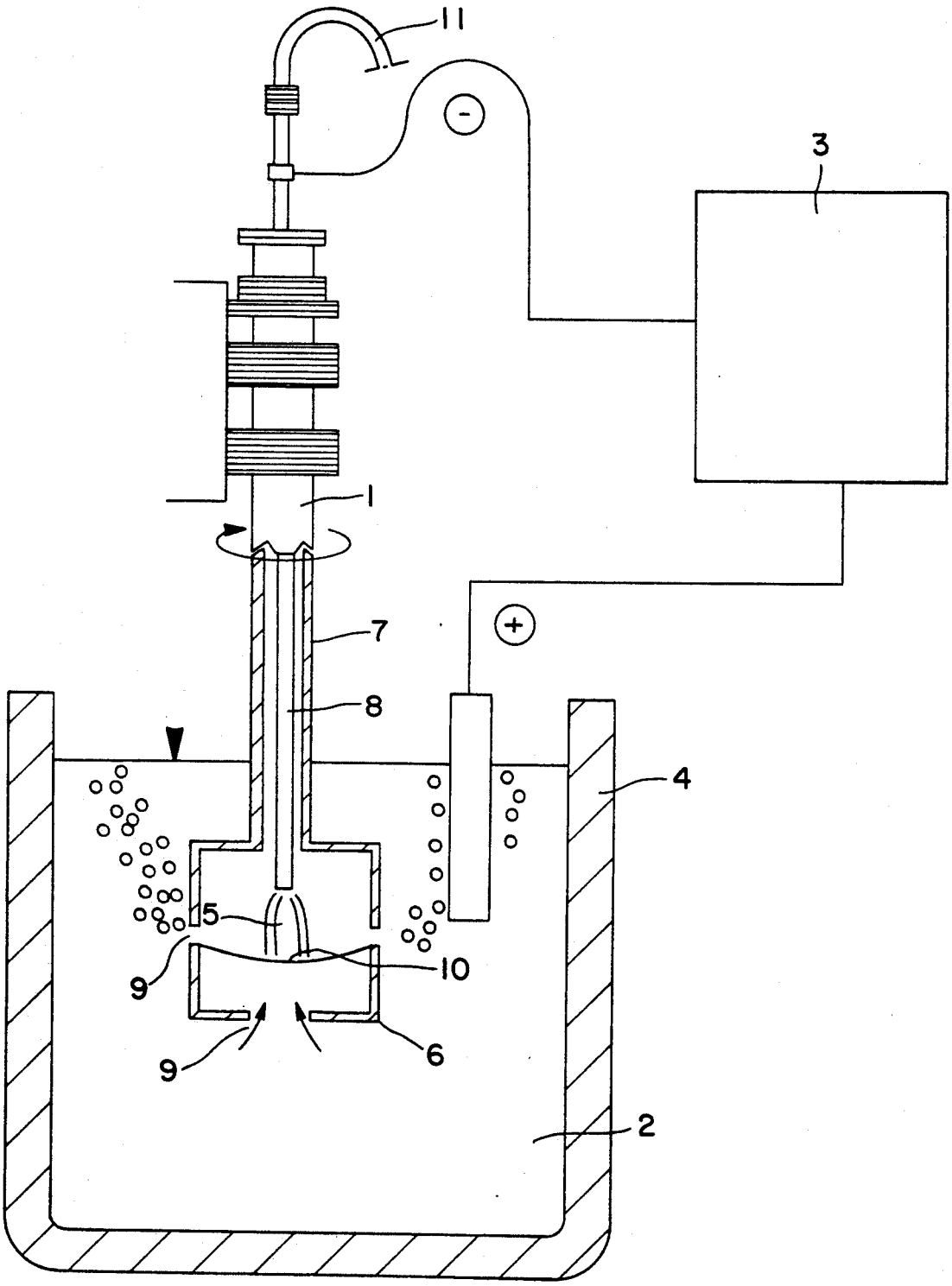

The present invention relates to a new method for grain refining of a metal structure, and more particularly grain refining of light metals such as aluminium and aluminium alloys.

It is well known that in order to start the crystallization/solidification process during solidification of molten metals it is necessary, in addition to undercooling (chilling) of the melt, to provide ready crystals or nuclei in the melt. Normally, in a commercial melt there is always present a certain amount of undissolved particles/impurities such as oxides, carbides, etc. representing stabile nuclei. However, the problem is that the number of such nuclei is not sufficient, and anyway there is no possibility of achieving a reproduction control in order to provide a fine and uniform structure. Reduction of the grain size is an efficient way of improving the material characteristics, e.g. increase the strength, and therefore in practice grain refining means are intentionally added to the melt in order to increase the number of stabile nuclei, and as a result of this to achieve a fine grained structure. Titanium and especially titanium boride, usually added as a master alloy in the form of a rod or wire comprising from 4–6% Ti, 1% boron and the remainder aluminium, is nowadays the most common grain refining additive applied to aluminium and Al-alloys. Addition of titanium boride as a grain refining means functions well for most Al-alloys, but the drawback is first of all relatively high costs connected to this method, presently amounting to approximately US$6. per ton of treated aluminium, and furthermore the fact that borides are generally undesirable in aluminium.

U.S. Pat. No. 4,793,971 discloses a method for adding alloying/refining material having a high dissolution rate by converting the alloying material into a spray of superheated alloy material and directing the spray into the molten metal at a predetermined depth below the metal surface. The alloying material in the form of an elongated element (rod) having a free end is continuously fed into a spark cup through its upper inlet, and an electrical arc is maintained between the submerged metal surface and the alloying element in the spark cup. Thus provided superheated spray of the alloy material is directed by a continuous supply of shielding gas onto the submerged metal surface, where the material dissolves and disperses in the melt. The shielding/carrier gas, supplied at a flow rate which maximizes the projection of the spray into the melt, is preferentially an ionizable gas such as argon or even helium having a high ionization potential which facilitates transferring more heat into the metal.

In a particular embodiment of the invention where a metallic titanium rod is applied as a grain refining additive to molten aluminium, formation of titanium aluminide ($TiAl_3$) in situ as grain refiner nuclei is achieved by the reaction between the vaporized titanium and the molten aluminium. This represents an improvement in terms of efficiency and economy compared to the former simple introduction of a titanium rod into molten aluminium. However, expensive titanium material is still to be used, and furthermore the disclosed method and apparatus does not seem to be able to assure a uniform distribution of titanium/titanium aluminide nuclei through the whole volume of the molten aluminium metal.

It is therefore an object of the present invention to provide a new method for grain refining of metals being substantially cheaper than the methods known so far. This is achieved by provision of a method according to the accompanying patent claims.

The invention will now be described in more detail by means of examples and referring to the drawing, where FIG. 1 shows schematically in a vertical cross-section an apparatus applied in a preferred embodiment of the invention, and in conjunction with an apparatus particularly suitable to conduct the method as disclosed in U.S. Pat. No. 4,568,385.

The apparatus schematically illustrated in a vertical cross-section in FIG. 1, comprises a rotor 1, submerged in molten metal 2 and comprising a hollow shaft 7 and a hollow rotor body 6 having openings 9 provided along the body's perimeter and its bottom part, is connected to a source of current 3 by means of an electrode 8 situated co-axially within the shaft 7. An electrical arc 5 is generated between the electrode's lower part and the rotating parabolic melt surface provided during the rotation of the rotor body 6. A gas conduit 11 is attached to the top of the shaft 7 in order to provide the desirable atmosphere over the melt and/or to feed to the melt inert (passive) or active gases for the purpose of refining.

The movement of the rotor body 6 causes a portion of the melt inside the rotor to rotate and develop an upper surface having a paraboloid shape where centripetal forces eject the melt through the side openings of the rotor under the surface of the surrounding melt, while the melt circulates upwardly into the rotor body through the bottom opening. Thus a very efficient mixing of e.g. molten metal is achieved so that the rotor is especially suitable, besides heating, also for refining or alloying of metal melts.

During the tests with the above melt treating apparatus it has been found that by using nitrogen as a passive refining gas aluminium nitride (AlN) particles were formed and distributed through the melt, functioning as solidification nuclei, something which resulted in a fine grained structure on the cast metal.

These AlN particles are formed partly by evaporation of aluminium at temperatures over 2000° C. reacting with the gaseous nitrogen and condensing inwardly on the rotating body and/or by contacting the melt. However, most of the particles are formed in situ by reaction between the Al-melt and the atomized and ionized nitrogen generated around the electric arc. These particles, having a very small size are, thanks to the specially shaped rotor, distributed quickly, uniformly and efficiently through the whole volume of the melt, ensuring an extremely fine and uniform distribution of appropriately sized grain refining nuclei.

More details and parameter characteristics for the new grain refining method will be apparent from the following practical examples.

EXAMPLE 1

770 kg AlSi-melt was treated batchwise by means of the above described apparatus during a period of 5 minutes. A graphite anode was applied during the trial, together with an electric arc effect (direct current) of 50 KW. Nitrogen was supplied at a ratio of 10 l/minute and the melt temperature was kept between 780°–840°

C. The resulting grain size on the cast metal was below 100 μm.

EXAMPLE 2

20 tons of AlSi-melt was passed through a treatment unit installed in a holding furnace. The same process parameters as in Example 1 were applied-arc effect of 50 KW and a nitrogen feeding rate 10 l/minute. The grain size of the cast metal was under 100 μm. As apparent from the examples, the method can be applied both batchwise and in a continuous casting process (in-line) either as a finalizing treatment step by means of an apparatus (treatment unit) readily installed in furnaces for the refining treatment, or by means of a separate unit built upon the same principles—provision of nitrogen around an electric arc and an efficient transport and distribution of the AlN-particles in the melt.

This in situ formation of grain refining nuclei represents a great improvement of the refining processes known so far both with regard to efficiency and economy of grain refining of Al-alloys.

As previously mentioned there is no need for a rather expensive master alloy rod of titanium ($TiB_2$) as a grain refining material to be applied in the refining process. Furthermore, use of carrier gas like argon or helium in sufficient amounts/rates to enhance entry of the grain refining material is eliminated. Apart from representing additional costs, the use of excessive gas flow rates in order to maximize the projection of superheated material spray into the melt, something which is important for the dissolution and recovery rates of the alloying/refining material according to the disclosure of prior art, may introduce some disturbance of the process, have impact on the thermal balance and even cause a contamination of the melt by entrapping of e.g. surface oxides.

In the grain refining process according to the present invention the applied nitrogen gas rates correspond to the amount of nitrogen required to form grain refining nitrides. There are no secondary requirements to the gas since the extremely fine and uniform distribution of the ionized gas particles in the melt is automatically ensured by the submerged rotating hollow body.

It is also possible instead of direct current to apply directly alternating current. Furthermore, the graphite anode can be substituted by a plasma burner in order to provide an electric arc between inert materials, or an active anode can be used made of materials being dissolved in the melt and thus participating actively in the formation of nuclei. For example, using a titan rod as an active anode will result in an additional provision of nuclei, preferentially $Ti_4O_7$, formed in situ by a reaction between the reduced titanium and the melt constituents (oxides).

Even if the above examples and description are based on the use of nitrogen and nitrides as grain refining means, it is obvious that also other materials can be used and consequently other refining means formed in the melt according to and without departing from the framework and spirit of the present invention. For example, carbides could be formed in a similar manner to nitrides, by substitution of nitrogen by a suitable carbon comprising gas.

We claim:

1. A method for grain refining of molten light metals, which comprises providing a molten metal having a melt surface, providing an electric arc over the surface of the molten metal, simultaneously supplying gas surrounding the electric arc, ionizing the gas by means of the electric arc and distributing the ionized gas through the melt, and forming, in situ, grain refining means by reaction between the ionized gas and the molten metal.

2. The method according to claim 1, wherein the electric arc is formed between at least one electrode and the surface of the molten metal.

3. The method according to claim 1, wherein the electric arc is formed between two electrodes.

4. The method according to claim 1, wherein the electric arc is formed in a rotating hollow body submerged in the melt and provided with an opening in a bottom wall of the body and plural openings in side walls of the body, whereby the melt circulates upwardly into the body through the bottom wall opening and outwardly from the body through the plural side wall openings.

5. The method according to claim 1, wherein the gas is nitrogen and the in situ formed grain refining means is a nitride.

6. The method according to claim 5, wherein the melt consists essentially of aluminium or Al-alloy and the grain refining means is aluminium nitride.

* * * * *